US008336862B2

(12) United States Patent
Priefert et al.

(10) Patent No.: US 8,336,862 B2
(45) Date of Patent: Dec. 25, 2012

(54) FENCE POST

(75) Inventors: William Dean Priefert, Mt. Pleasant, TX (US); Rocky Christenberry, Mt. Vernon, TX (US); Kelly Donnelly, Mt. Pleasant, TX (US)

(73) Assignee: Priefert Mfg. Co, Inc., Mt. Pleasant, TX (US)

( * ) Notice: Subject to any disclaimer, the term of this patent is extended or adjusted under 35 U.S.C. 154(b) by 59 days.

(21) Appl. No.: 12/481,463

(22) Filed: Jun. 9, 2009

(65) Prior Publication Data

US 2009/0302292 A1 Dec. 10, 2009

Related U.S. Application Data

(60) Provisional application No. 61/059,895, filed on Jun. 9, 2008.

(51) Int. Cl.
*E04H 17/20* (2006.01)

(52) U.S. Cl. ..... 256/65.11; 256/72

(58) Field of Classification Search ..... 256/65.11, 256/65.02, 72, 19, 52, 65.15, 22, 64, DIG. 5, 256/58; 403/263, 245, 347
See application file for complete search history.

(56) References Cited

U.S. PATENT DOCUMENTS

| | | | | | |
|---|---|---|---|---|---|
| 133,853 | A * | 12/1872 | Hall | 256/59 |
| 175,771 | A * | 4/1876 | Sickler | 52/166 |
| 304,496 | A * | 9/1884 | Brock | 256/65.15 |
| 910,950 | A * | 1/1909 | Noll | 256/19 |
| 2,783,029 | A * | 2/1957 | Fisher et al. | 256/19 |
| 3,519,292 | A * | 7/1970 | Krikorian | 403/258 |
| 3,638,814 | A * | 2/1972 | Lowery | 211/189 |
| 3,972,639 | A * | 8/1976 | Lening | 403/191 |
| 4,175,883 | A * | 11/1979 | Lemelson | 403/347 |
| 4,195,888 | A * | 4/1980 | Squire | 312/408 |
| 4,326,354 | A * | 4/1982 | Hagberg | 446/126 |
| 4,702,459 | A * | 10/1987 | Moschner | 256/19 |
| 4,735,468 | A * | 4/1988 | Taylor et al. | 312/408 |
| 6,014,941 | A * | 1/2000 | Bent et al. | 116/63 R |
| 6,164,629 | A * | 12/2000 | Michael et al. | 256/65.11 |
| 6,626,406 | B1 * | 9/2003 | Olson, Jr. | 248/219.3 |
| 7,913,983 | B1 * | 3/2011 | Sandor, Sr. | 256/67 |
| 2010/0314596 | A1 * | 12/2010 | Thomas | 256/19 |

FOREIGN PATENT DOCUMENTS

| | | | |
|---|---|---|---|
| JP | 04189908 | A * | 7/1992 |
| JP | 06117150 | A * | 4/1994 |

* cited by examiner

*Primary Examiner* — Joshua Kennedy

(74) *Attorney, Agent, or Firm* — Davis, Brown, Koehn, Shors & Roberts, P.C.; Kent A. Herink

(57) ABSTRACT

A fence post for use in building a post and rail fence over varying terrain or of varying curvature. The post is perforated by a hole having a reduced diameter center section that is flanked on either side by an enlarged diameter section. The posts thus permit the support of rails that are not restricted to a straight, horizontal orientation and provide and improved overall appearance.

6 Claims, 6 Drawing Sheets

FENCE POST

This application claims priority to U.S. Patent Application Ser. No. 61/059,895, filed on Jun. 9, 2008.

BACKGROUND OF THE INVENTION

The present invention relates generally to fence posts and, more specifically, to fence posts in which have been formed shaped holes for supporting a tubular fence rail.

Fences are in common use for defining property boundaries, for the containment of animals, for decorative purposes, and so on. While fences take on a wide plurality of forms, a common type of fence is comprised of a plurality of spaced-apart, ground supported posts and a plurality of fence rails supported on the posts and which form a barrier. The posts are plumb and typically all of a common height. The rails are supported in holes formed in the posts, with a first end of a rail supported in a first post and the second end of the rail supported in an adjacent, second post. If the terrain is level and the fence section is straight, the rails are horizontal and the holes are formed in the post having a diameter slightly larger than the outside diameter of the rail and with a horizontal orientation. If, however the terrain of the fence is not level, the rails will not be horizontal and will not fit within the horizontal, closely formed holes in the post. The same problem exists if the fence is curving. This problem has typically been handled in the past by custom forming the holes in the posts at the site to correspond to the particular terrain. This prevented the manufacture of identical finished posts and required the installer to custom drill many of the posts. Another approach to handling uneven terrain has been to drill the oversized holes in the posts to accommodate rails at an angle. The problem with this approach is that the rails rest on the bottom of the oversized holes and give an off-center look to the hole and the rail.

There is a need for a mass-produced fence post that will accommodate and support rails over uneven terrain with a pleasing, centered appearance.

SUMMARY OF THE INVENTION

The present invention consists of a fence post that has a shaped hole for supporting fence rails over a wide range of angles to accommodate uneven terrain and curving sections of fencing. In a preferred embodiment, the posts are formed with perforating holes that have a central, smaller diameter section and a pair of flanking, larger diameter sections. The posts support fence rails that can take an angle to accommodate both uneven terrain and curving sections of the fence. The ends of the rails are preferably supported at one end on the smaller diameter section and the larger diameter flanking sections will help to mask any off-center position of the rail in the post. The invention also convenient to install because the posts can be set in the ground first and then the rails can be fed into the posts without having to start from one end of the whole fence in that a rail can be inserted at each post.

DESCRIPTION OF PREFERRED EMBODIMENTS OF THE INVENTION

Figure 1:
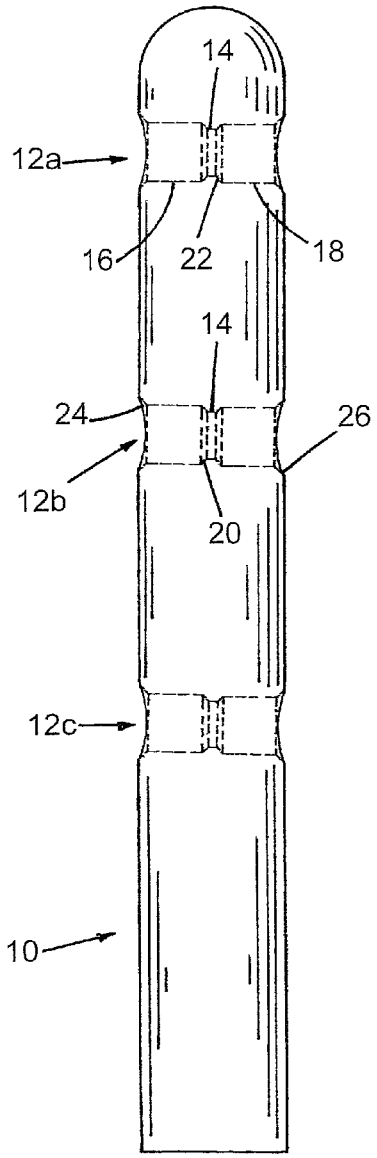
FIG. 1 is a side elevational view of a preferred embodiment of a post of the present invention showing in broken line a profile of shaped holes.
Figure 2:
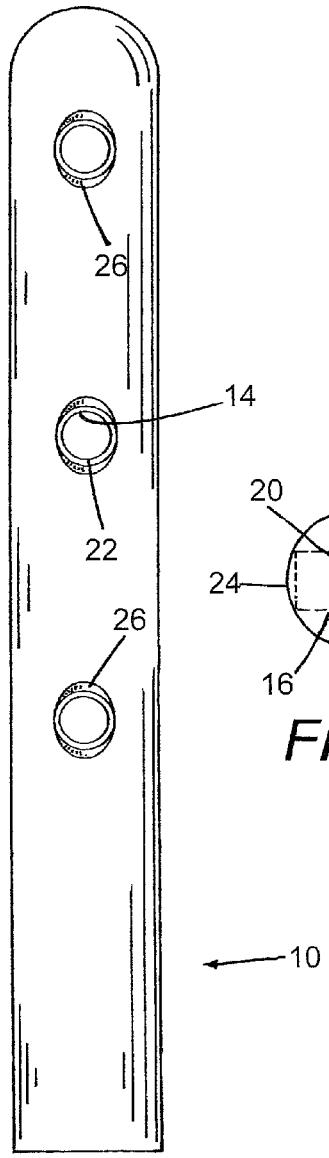
FIG. 2 is a side elevational view taken at right angles to the view of FIG. 1.
Figure 3:
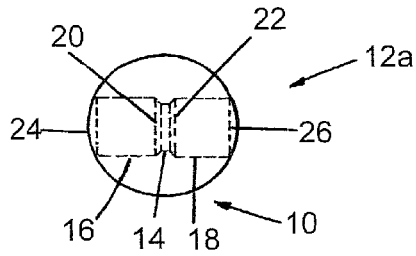
FIG. 3 is a top view corresponding to FIG. 1.
Figure 4:
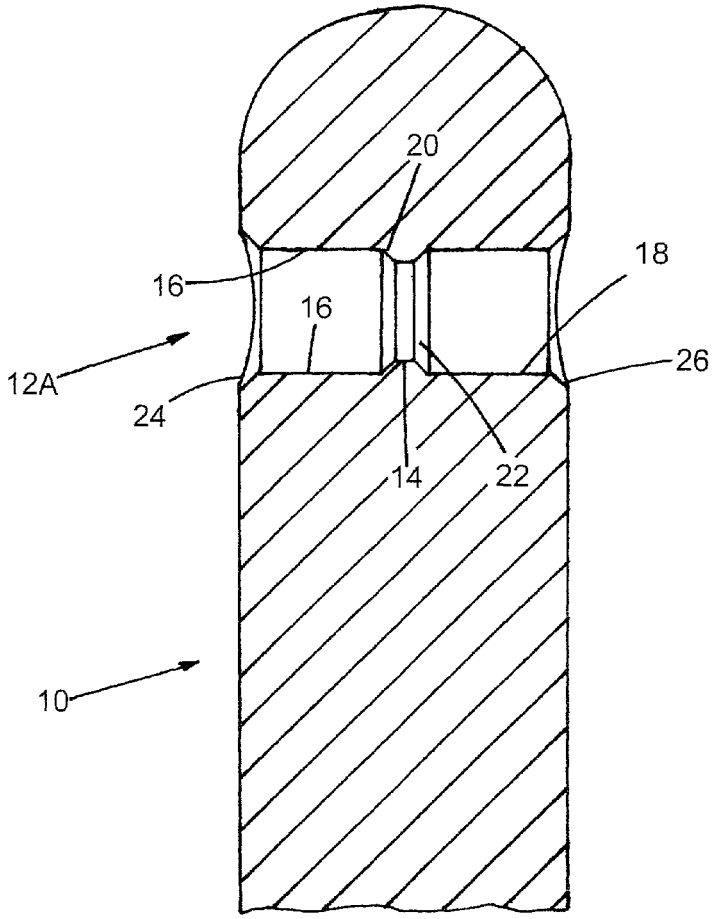
FIG. 4 is a cross-sectional of the upper end of the post of FIG. 1.

Illustrated in FIGS. 1-4, generally at 10, is a post representing a preferred embodiment of the present invention. The post 10 has three perforating holes 12*a*, 12*b*, and 12*c*. Each of the holes 12 includes a central section 14 having a smaller, first diameter, a first flanking section 16 of a larger, second diameter and a second flanking section 18 also of a larger, second diameter. In the preferred embodiment of the post 10, a first inner beveled section 20 transitions between the central section 14 and the flanking section 16 and a second inner beveled section 22 transitions between the central section 14 and the flanking section 18. Also in the preferred embodiment of the post 10, a first outer beveled section 24 flares outwardly from the flanking section 16 and a second outer beveled section 26 flares outwardly from the flanking section 18.

Figure 5:
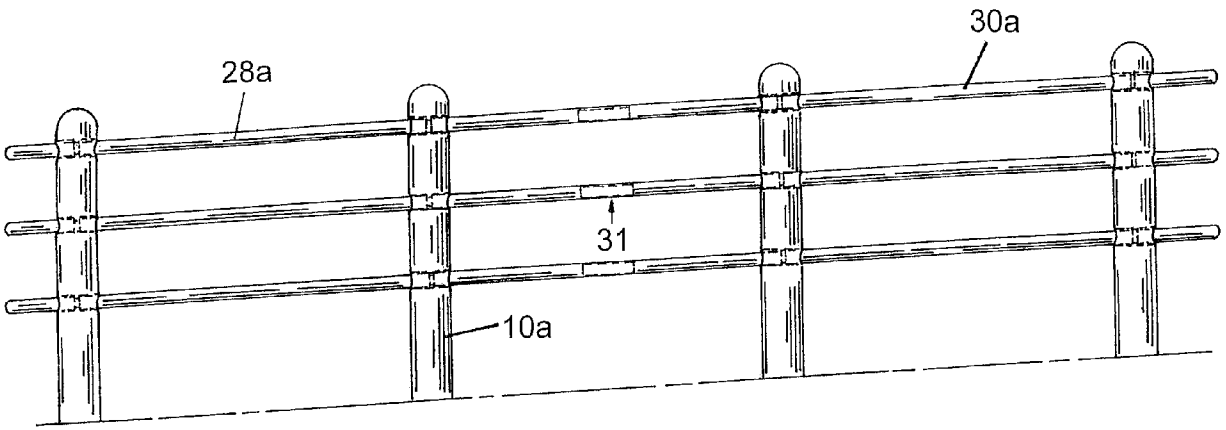
FIG. 5 is a side view of a series of four posts of FIG. 1 placed on terrain of constant slope with a plurality of fence rails supported between the posts.
Figure 6:
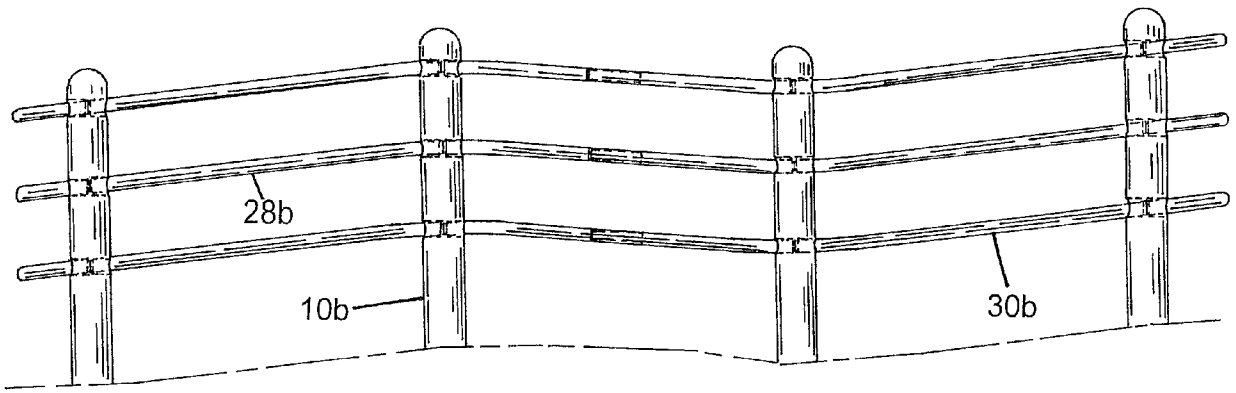
FIG. 6 is a side view of a series of four posts of FIG. 1 placed on terrain of changing slope with a plurality of fence rails supported between the posts
Figure 7:
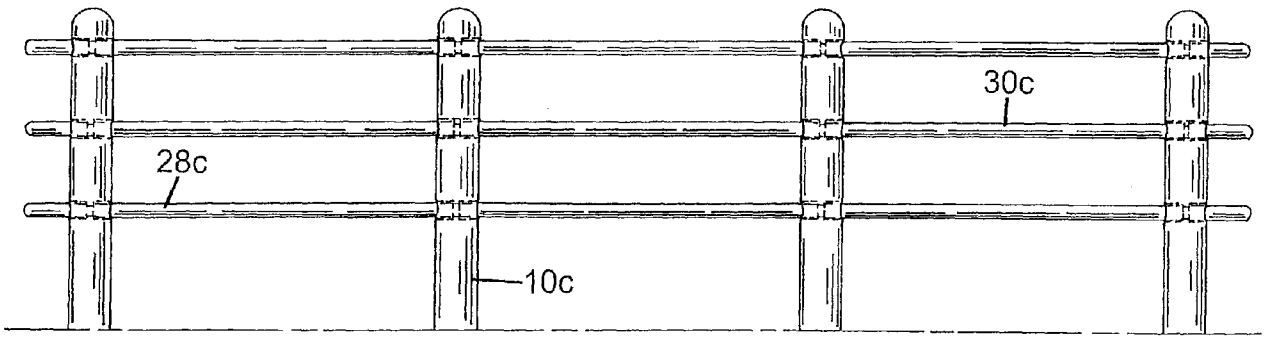
FIG. 7 is a side view of a series of four posts of FIG. 1 placed on level terrain with a plurality of fence rails supported between the posts.
Figure 8:
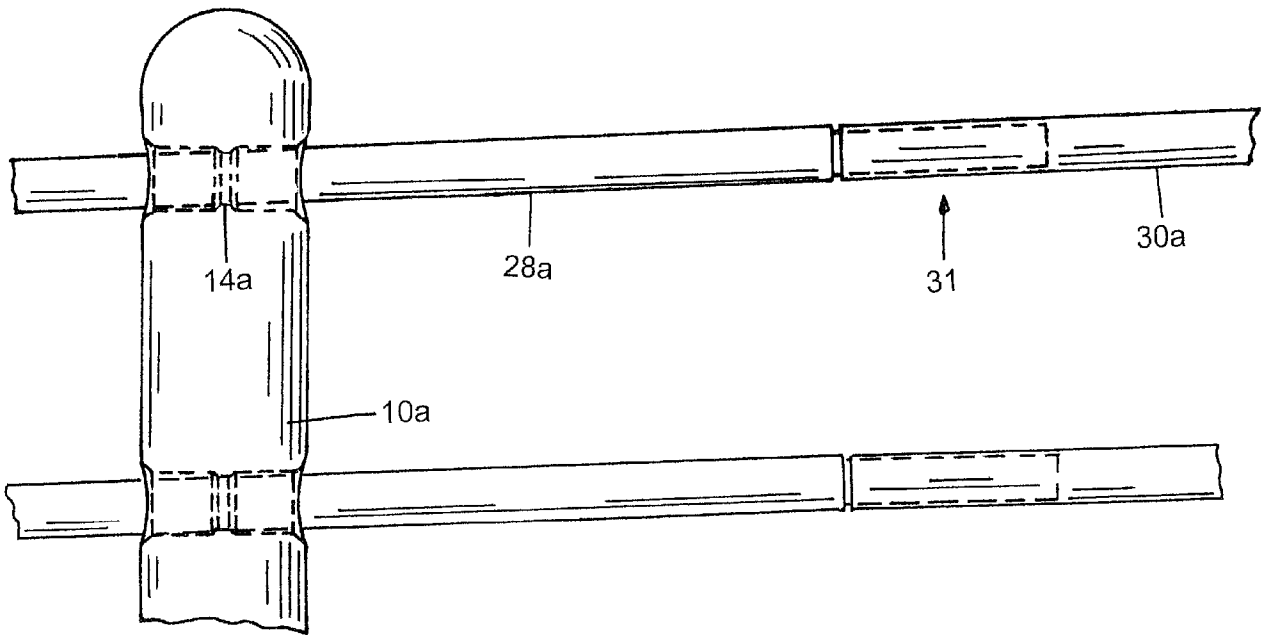
FIG. 8 is an enlarged view of the top of the post designated 10*a* in FIG. 5.

As illustrated in FIGS. 5-7, a plurality offence rails 28 and 30 may be supported by the posts 10. Each rail 28 has a first end of a reduced diameter so that it can be received within a close fit inside the second end portion of an adjacent rail 30, as illustrated at 31. This swedge connection permits the rails 28, 30 to expand and contract with changes in temperature while maintaining the physical connection between the rails 28, 30. FIG. 5 illustrates the use of the present invention on terrain of a constant slope, increasing from left to right. The rail 28*a* is supported on the smaller diameter, central section 14*a* (FIG. 8). Whereas the smaller section 14*a* is of a sufficient size to accommodate the rails 28*a*, 30*a*, if the flanking sections 16*a*, 18*a* were not enlarged, the rails 28*a*, 30*a* would not fit in the post 10*a*.

Figure 9:
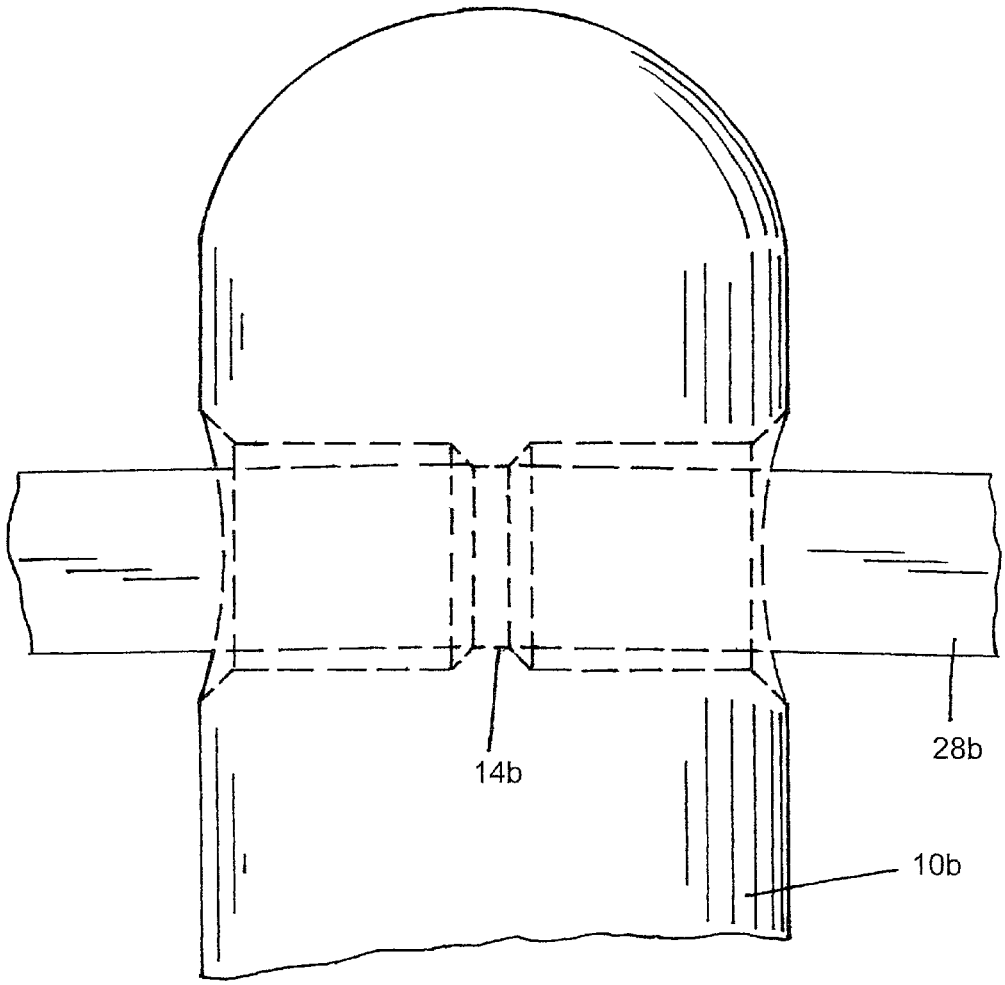
FIG. 9 is an enlarged view of the top of the post designated 10*b* in FIG. 6.

FIG. 6 illustrates the use of the present invention on terrain of changing slope, wherein post 10*b* is on higher terrain than either of the adjacent posts. The rails 28*b*, 30*b* are supported on the smaller diameter, central section 14*b* (FIG. 9). Whereas the smaller section 14*b* is of a sufficient size to accommodate the curving rails 28*b* and 30*b*, if the flanking sections 16*b*, 18*b* were not enlarged, the rails 28*b*, 30*b* would not fit in the post 10*b*.

FIG. 7 illustrates the use of the present invention on level terrain. The rails 28*c*, 30*c* are supported on the smaller diameter, central section 14*c* (FIG. 10). In this idealized condition, the enlarged flanking sections 16*c* and 18*c* are not needed.

It will be appreciated by those skilled in the art that although the preferred embodiment has been described as accommodating terrain of uneven slope, the enlarged sections 16 and 18 will also accommodate use of the post 10 and rails 28 and 30 to create a curved section of fencing wherein the rails 28 and 30 will reside relatively on the right or left side of the enlarged sections 16 and 18.

Since the rails 28, 30 on a common post 10 are preferably supported on the smaller diameter central section 14, the rails 28, 30 are already somewhat centered. In addition, the bevels 24 and 26 serve to reduce the visual appearance of an off-center rail 28, 30 by providing a visual space on both sides of the rail 28, 20 regardless of the precise centering of the rail 28, 30. The present invention thus improves the visual appearance of the fence when used over terrain that is other than level.

The posts 10 of the present invention also provide an advantage in assembling the fence. The shape of the holes 12 allows all of the posts 10 to be installed first and then the rails 28, 30 can be fed into position through the holes 12 despite variations in the terrain or shape of the fence being formed.

While the through-holes of the posts have been described with respect to a preferred embodiment having sections of constant diameter, the present invention is not so limited. For example, the enlarged sections could be beveled with a diameter that increases from the inner region of the post to the outer region.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

We claim:

1. A fence post and rail combination for building a section of fence, comprising: a continuous fence rail having a substantially constant cross-sectional size along its entire length that passes through a fence post having a generally circular through-hole, said through-hole having a generally circular central section of reduced cross section diameter that supports the fence rail surrounded on either side by generally circular inner bevels, flanked on either side by a generally circular and an outwardly flaring flanking section having an enlarged cross section diameter relative to the central section which allow for radial play of the rail relative to the post to accommodate both uneven terrain and curving sections of the fence.

2. A fence post and rail as defined in claim 1, further comprising a generally circular outer bevel that flares further outwardly from each of the enlarged diameter flanking sections to the exterior of the post.

3. A method of building a post and rail fence, comprising the steps of:

(a) installing a plurality of posts each post having a generally circular through-hole, said through-hole having a generally circular central section of reduced cross section diameter surrounded on either side by generally circular inner bevels, flanked on either side by a generally circular and an outwardly flaring flanking section having an enlarged cross section diameter relative to the central section;

(b) inserting a first end of a continuous fence rail having a substantially constant cross-sectional size along its entire length through the generally circular through-hole in a first post such that the through-hole supports the fence rail, the flanking sections allowing for radial play of the rail relative to the post to accommodate both uneven terrain and curving sections of the fence; and (c) pushing the rail through the post until the first end is supported on an adjacent second post.

4. A fence post and rail combination for building a section of fence, comprising: a continuous fence rail having a substantially constant cross-sectional size along its entire length passing through a through-hole in a fence post, said through-hole having a through-hole having a generally rounded central section of reduced diameter that supports the fence rail passing therethrough, surrounded on either side by a generally rounded inner bevel, flanked on either side by a generally rounded flanking section having an enlarged cross section diameter, allowing for radial play of the rail relative to the post to accommodate both uneven terrain and curving sections of the fence.

5. A fence post and rail as defined in claim 4, further comprising a generally rounded outer bevel of increased diameter that flares outwardly from each of the enlarged cross section diameter sections to the exterior of the post.

6. A fence post and rail combination for building a section of fence, comprising: a continuous fence rail having a substantially constant cross-sectional size along its entire length that passes through a fence post having a generally circular through-hole which allows for passage of the rail, said through-hole having a generally circular central section of reduced cross section diameter that supports the fence rail surrounded on either side by generally circular inner bevels, flanked on either side by a generally circular and an outwardly flaring flanking section having an enlarged cross section diameter relative to the central section, and a generally circular outer bevel that flares outwardly from each of the enlarged diameter flanking sections to the exterior of the post which allows for radial play of the rail relative to the post to accommodate both uneven terrain and curving sections of the fence.

* * * * *